United States Patent [19]

Oliver, III

[11] Patent Number: 4,936,594

[45] Date of Patent: Jun. 26, 1990

[54] PORTABLE ENTERTAINMENT CENTER

[76] Inventor: Robert G. Oliver, III, 17 Pirates Cove, Hampton, Va. 23669

[21] Appl. No.: 324,658

[22] Filed: Mar. 17, 1989

[51] Int. Cl.[5] ..... B62B 1/10

[52] U.S. Cl. ..... 280/47.19; 280/47.25; 280/47.315; 280/47.35

[58] Field of Search ..... 280/652, 655, 654, 655.1, 280/47.34, 47.35, 47.24, 47.25, 47.17, 47.19, 47.18, 47.26, 47.131; 297/DIG. 4; 312/235.1, 235.2, 235.3, 237

[56] References Cited

U.S. PATENT DOCUMENTS

| | | | |
|---|---|---|---|
| D. 133,094 | 7/1942 | Amborton | 312/235.1 |
| 2,190,498 | 2/1940 | Williams | 312/237 |
| 2,661,959 | 12/1953 | Bell | 280/47.25 |
| 2,842,373 | 7/1958 | Doerr | 280/47.19 |
| 2,883,731 | 4/1959 | Wells | 280/47.19 |
| 3,874,531 | 4/1975 | Mayo | 280/47.35 |
| 3,897,080 | 7/1975 | Isom | 280/47.19 |
| 3,930,662 | 1/1976 | Manner | 280/652 |
| 3,984,162 | 10/1976 | Zozzaro | 312/100 |
| 4,132,236 | 1/1979 | Peterson | 135/16 |
| 4,280,744 | 7/1981 | Nakano | 312/240 |
| 4,318,567 | 3/1982 | Guthier | 297/184 |
| 4,448,434 | 5/1984 | Anderson | 280/654 |
| 4,455,030 | 6/1984 | Rosen | 280/47.19 |
| 4,457,527 | 7/1984 | Lowry | 280/47.19 |

*Primary Examiner*—David M. Mitchell
*Attorney, Agent, or Firm*—Wallace J. Nelson

[57] ABSTRACT

A compact portable entertainment center 10 is disclosed and includes a stereo component 30 supported on a speaker cabinet 13 and supported by and attached to a tubular frame 11. A seat member 28 and a serving tray 31 are attached to frame 11 in spaced relationship to each other and to the stereo component. An umbrella 49 is releasably attached to bent ends of the tubular frame and spans the folding tray, seat, stereo and speaker cabinet structure. Upon removal of the umbrella unit, the bent ends of the tubular frame are rotated 180° and serve as handles, which coupled with a pair of wheels 20,21 permit the frame to serve as a dolly for manual movement of the entertainment center for the selective indoor/outdoor use.

3 Claims, 1 Drawing Sheet

PORTABLE ENTERTAINMENT CENTER

FIELD OF THE INVENTION

This invention relates to a compact portable entertainment center adapted for easy maneuverability to permit use as an indoor/outdoor entertainment center.

BACKGROUND OF THE INVENTION

In our urban oriented society we are resorting to more back yard barbecues, patio cookouts, and picnics for entertainment of ourselves and our guests. No outdoor function is complete without music and portable radios and stereo units are frequently employed to supply this music. Extra chairs or seats for the host and/or guests, along with other comfort added features, such as shade umbrellas and serving tables are always welcome for such events. An entertainment center that can be used indoors to provide music, and outdoors to supply music, seating, shading and a serving table or tray would appear to be a valuable additional furniture item for most homes.

It is therefore an object of the present invention to provide a compact portable entertainment center adapted for indoor/outdoor use.

Another object of the present invention is a portable unit to provide stereo music entertainment, seating, shade and serving space for outdoor functions.

A further object of the present invention is a portable entertainment unit providing music, seating, and shade.

An additional object of the present invention is a dolly-type framed, compact, portable, stereo entertainment unit for indoor/outdoor use.

A further object of the present invention is an entertainment center that may be converted into a wheeled dolly for easy movement.

SUMMARY OF THE INVENTION

According to the present invention the foregoing and additional objects are attained by providing a stereo component and a cabinet housing at least one speaker for the stereo component attack to and supported by a tubular frame. A seat member and a serving tray are attached to the frame in spaced relationship to each other and to the stereo component. An umbrella is releasably attached to bent ends of the tubular frame and spans the folding tray, seat and stereo/speaker cabinet structure. Upon removal of the umbrella unit the bent ends of the tubular frame are rotated 180° and serve as handles which, coupled with a pair of wheels at the opposite end of the tubular frame, permits the frame to serve as a dolly for manual movement of the entertainment center for selective indoor/outdoor use.

BRIEF DESCRIPTION OF THE DRAWINGS

A more complete appreciation of the present invention and many of the attendant advantages thereof will be readily apparent as the same becomes better understood when considered in connection with the accompanying drawings wherein.

DETAILED DESCRIPTION OF THE PREFERRED EMBODIMENT

Figure 2:
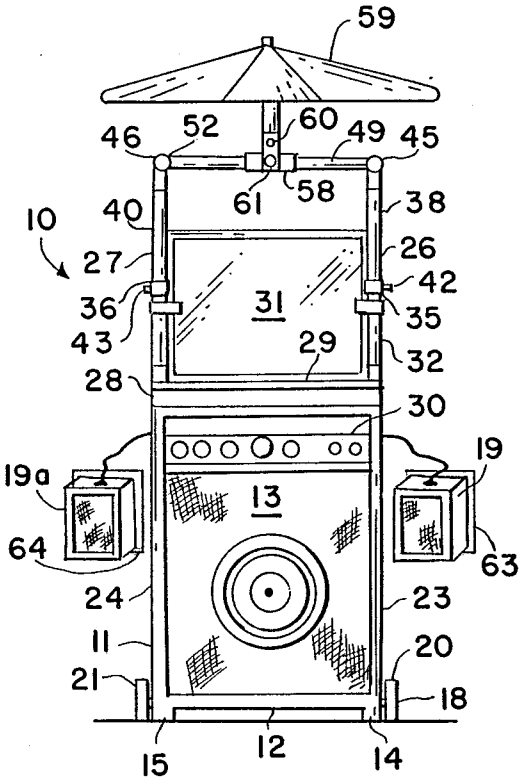
FIG. 2 is a front view of the present invention with the side speakers removed from their transport position and in position for outdoor use of the invention.
Figure 1:
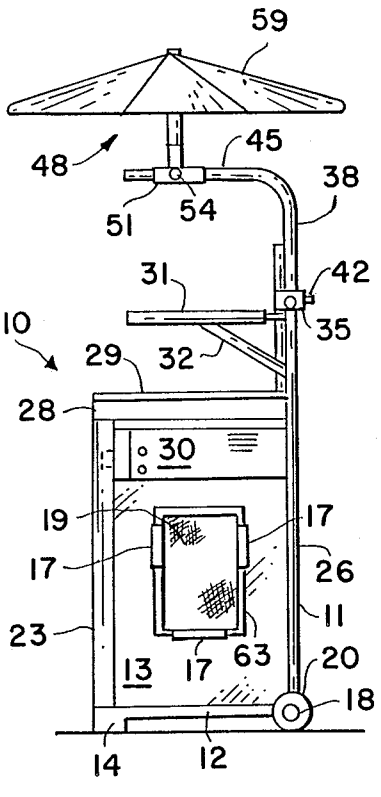
FIG. 1 is a side elevation view of the present invention.

Referring now to the drawings and more particularly to FIGS. 1 and 2, the portable entertainment center of the present invention is shown and generally designated by reference numeral 10. Entertainment center 10 includes a dolly-type frame 11 having a base portion 12 supporting a speaker cabinet 13. A pair of depending legs 14,15 extend from the opposite sides of the front side of base 12 and serve to engage surface 16. Surface 16 may be the ground, a wooden deck, concrete patio or like surface, including the floor of a hole. A plurality of brackets 17 are connected to speaker housing 13 and serve to releasably retain additional speakers 19, 19*a*, as will be further explained hereinafter. An axle 18 is conventionally secured to and extends the length of the back side of base 12. A pair of wheels 20,21 are rotatably secured to the ends of axle 18 and serve to engage a surface on the same horizontal plane as that engaged by depending legs 14,15 when entertainment center 10 is stationary.

A first pair of legs 23,24 extend vertically upward from base 12 and are co-linearly disposed relative to demanding legs 14,15 at the front corners of base 12. A second pair of legs 26,27 extend vertically upward from the back side corners of base 12.

A seat member 28, spaced from the top surface of cabinet 13, is secured to each one of the first and second pair of vertically extending legs 23,24 and 26,27. Seat member 28 is disposed on a horizontal plane parallel with base 12 and is capable of supporting the weight of an adult. A suitable cushion 29, such as for example a foam rubber pad, is positioned on seat member 28 and releasably retained thereon by conventional attachment/release mechanism (not shown).

A stereo unit 30 is positioned beneath seat 28 and rests on the top surface of speaker cabinet 13. A suitable electrical cord (not shown) is provided in connection with stereo unit 30 for operation thereof in a conventional manner.

A serving tray 31 is attached to second pair of legs 26,27 via a folding bracket assembly 32. Serving tray 31 is shown in the horizontal position of use in FIG. 1 and the folded out-of-way position in FIG. 2 it occupies when it is desired to sit on seat 28.

A pair of coupling sleeves 35,36 are disposed around the respective ends of legs 26,27 and serve to telescopically receive respective tubular frame extensions 38,40 therein. Individual thumbscrews 42,43 are provided on respective coupling sleeves 35,36 to frictionally engage and lock frame extensions 38,40 in the desired linear and angular relationship relative to leg pair 26,27.

Each of tubular frame extensions 38,40 is provided with a substantially 90° bend to provide respective hook-like end segments 45,46 thereon. An umbrella assembly 48 is releasably secured to end segments 45,46 via a tubular bracket 49. Tubular bracket 49 is provided with a pair of tubular T-couplings 51,52 at the respective ends thereof. The legs of T-couplings 51,52 are positioned on the respective ends of tubular bracket 49 with the cross bar of respective T-couplings 51,52 extending over the hook ends 45,46. Suitable thumbscrews 54,55 are provided on respective T-couplings 51,52 to frictionally engage ends 45,46 for releasably retaining tubular bracket 49 thereon.

A third T-coupling 58 is also provided on tubular bracket 49 at substantially the mid-length thereof. Tubular bracket 49 extends through the cross bar of T-coupling 58 and the T-leg serves to releasably retain the shaft of umbrella 59 therein. A thumbscrew 60 is provided through the T-leg to engage and releasably retain the shaft of umbrella 59 fixed therein. Another thumbscrew 61 is provided through the cross bar of T-coupling 58 to releasably retain T-coupling 58 in adjustable angular relationship on tubular bracket 49.

Figure 3:
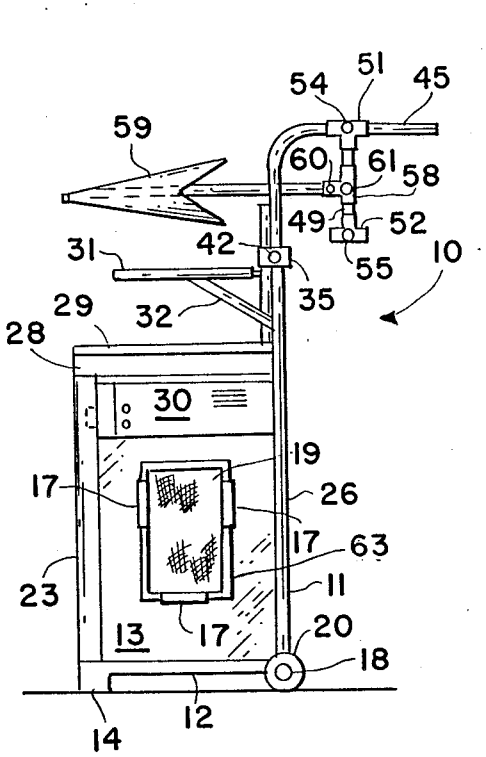
FIG. 3 is a side view of the present invention in the transport and indoor use mode.

Referring now more particularly to FIG. 3, entertainment center 10 is shown in the mobile or transport condition. In this mode, entertainment center 10 may also be used indoors. As shown therein, thumbscrews 54,55 have been loosened and tubular bracket 49 removed from hook end segments 45,46. Thumbscrews 42,43 on coupling sleeves 35,36 are also loosened and tubular frame extensions 38,40 telescopically moved within respective second leg members 26,27. Tubular frame extensions 38,40 are also rotated 180° from the position shown in FIGS. 1 and 2 to the position shown in FIG. 3 and thumbscrews 42,43 are again tightened. In this position the hook-like end extensions 45,46 serve as handles for movement of the wheeled entertainment center 10. After end segments 45,46 are rotated 180° from the positions thereof shown in FIG. 2 to the position shown in FIG. 3, one end T-coupling, for example 51, is again positioned on segment 45 and thumbscrew 54 tightened to retain tubular bracket 49 in the position shown in FIG. 3.

Umbrella 59 is maintained in the collapsed position shown and extends over the unfolded serving tray 31. Entertainment center 10 may then be tilted onto wheels 20,21 by handles 45,46 and wheeled to the desired indoor/outdoor site of use. For indoor use the entertainment assembly may be used as shown in FIG. 3. For outdoor use, upon reaching the destination desired, the thumbscrews 54, 42, and 43 are again loosened, umbrella assembly 48 removed from hook-end segment 45, the hook end segments 45,46 are rotated 180° to the position shown in FIGS. 1 and 2, while extending frame extensions 38,40 to the desired length, and thumbscrews 42,43 tightened for retention thereof. Umbrella assembly 48 is again attached to hook ends 45,46 via couplings 51,52 and latched into position by thumbscrews 54,55. Thumbscrew 61 is loosened to adjust the angular position of umbrella 59 (if desired) and the umbrella expanded.

Speakers 19,19*a* are then removed from brackets 17 and positioned at the desired locations and stereo unit 30 is ready for operation when connected to a source of electric currant via a conventional plug-in connection (not shown). Speakers 19,19*a* are provided with respective peripheral flanges 63,64 for engagement of brackets 17 on speaker cabinet 13. For optimum operation speaker cabinet 13 houses a low frequency sub woofer while speakers 19,19*a* are conventional stereo speakers. Each of the speakers connect to the output of stereo unit 30 in a conventional manner.

No specific materials or dimensions for the present invention have been discussed and these may vary according to the tastes and desires of the builder and/or purchaser. In the preferred embodiment the overall height of entertainment center 10, in the operational mode illustrated in FIGS. 1 and 2, is approximately eight feet and the circumference of umbrella 59 is thirty inches. The transport mode shown in FIG. 3 has a height of approximately five feet and the outside dimensions of unit 10 is approximately two feet square. The back of speaker cabinet 13 is provided with a storage area for housing the wires connecting with speakers 19,19*a* and for housing the electrical connection wire for stereo unit 30. Additional storage area in cabinet 13 may also house suitable bar and/or picnic supplies. Any suitable metal or plastics material may be employed for the frame component parts described herein as long as they are of adequate strength to support the loads required thereby. Speaker cabinets 13, 19, 19*a*, seat 28 and serving tray 31 may be constructed of any suitable wood, metal, plastics or like material.

Athough the invention has been described relative to a specific embodiment thereof, it is not so limited and numerous variations and modifications thereof will be apparent to those skilled in the art. For example, the specific bracket arrangement 17 for releasably attaching speakers 19,19*a* to speaker cabinet 13 is not limited to the three component bracket shown. This bracket arrangement could be a single piece U-shaped bracket for receiving the flanges 63,64 on speakers 19,19*a* or different connections other than the flange and bracket arrangement described, such as hooks and openings, may be used. These and other variations and modifications may be made in the present invention without departing from the spirit and scope of the appended claims.

It is therefore to be understood that, within the scope of the claims, the invention may be practiced otherwise than as specifically described herein.

What is claimed as new and desired to be secured by Letters Patent of the United States is:

1. A portable entertainment center comprising in combination:

a dolly-type frame;

said dolly-type frame including a base having a front side and a back side;

a pair of depending legs extending from the opposite ends of said front side of said base for engaging a surface;

an axle secured to and extending the length of said back side of said base;

a pair of wheels rotatably secured to the ends of said axle and adapted to engage a surface on the same horizontal plane as that engaged by said pair of depending legs;

a first pair of legs colinear with said pair of depending legs and upwardly extending from said front side of said base;

a second pair of legs upwardly extending from opposite ends of said back side of said base;

a seat member spaced from said base and secured to each of said first and said second pair of legs upwardly extending from said base;

said seat member being disposed on a horizontal plane parallel with that of said base;

a cabinet member having one end surface integrally secured to said base and the opposite end surface thereof spaced from said seat member;

said first and said second pair of legs being secured to the corners of said cabinet member;

at least said second pair of upwardly extending legs being of a tubular construction and having an end extending beyond the connection thereof with said seat member;

a tubular frame extension telescopically received within the end of each of said second pair of upwardly extending legs;

each said tubular frame extension having a first end portion telescopically and rotatably received by one of said second pair of upwardly extending legs, and a second end portion angular bent at substantially 90° relative to said first end portion;

adjustment means for releasably locking each said tubular frame extension in the desired vertical and angular relationship relative to each said second pair of upwardly extending legs;

an umbrella assembly releasably secured to said second end portions of said tubular frame extensions;

said umbrella assembly including a support tubular bracket having each end thereof releasably and adjustably received by one of said tubular frame extensions;

a perpendicularly disposed tubular connection integral with said tubular bracket at substantially the midlength thereof; and a collapsible umbrella releasably secured to said perpendicularly disposed tubular connection.

2. A portable entertainment center comprising:

a stereo component and a cabinet housing at least one speaker for said stereo component;

a tubular frame attached to and supporting said stereo component and said cabinet;

a seat member attached to said tubular frame;

a folding tray attached to said tubular frame and spaced from said seat member;

an umbrella attached to said tubular frame;

said umbrella being selectively collapsed and expanded and, when expanded, the expanded portion thereof having a diameter adequate to span said folding tray and said seat;

wheel members disposed on an end of said tubular frame to permit said tubular frame to serve as a dolly for transporting said stereo component, said seat and said folding tray from on site to another;

said tubular frame including a pair of telescoping segments;

said telescoping segments terminating in hook-like ends;

a tubular bar spanning said hook-like ends;

a perpendicular tubular section extending from substantially the midlength portion of said tubular bar; and said umbrella being releasably attached to said perpendicular tubular section.

3. The portable entertainment center of claim 2 wherein said tubular bar is releasably secured to said hook-like ends and when removed therefrom said hook-like ends may be rotated 180° to provide handle means to convert said tubular frame into a dolly-like assembly.

* * * * *